US006979958B2

(12) United States Patent
Zhu et al.

(10) Patent No.: US 6,979,958 B2
(45) Date of Patent: Dec. 27, 2005

(54) HIGH EFFICACY METAL HALIDE LAMP WITH PRASEODYMIUM AND SODIUM HALIDES IN A CONFIGURED CHAMBER

(75) Inventors: Huiling Zhu, Lexington, MA (US); Shin Ukegawa, Kyotanabe (JP); Hiroshi Nohara, Nishinomiya (JP); Jakob Maya, Lexington, MA (US)

(73) Assignees: Matsushita Electric Industrial Co., Ltd., Osaka (JP); Matsushita Electric Works, Ltd., Osaka (JP)

( * ) Notice: Subject to any disclaimer, the term of this patent is extended or adjusted under 35 U.S.C. 154(b) by 661 days.

(21) Appl. No.: 10/062,078

(22) Filed: Jan. 31, 2002

(65) Prior Publication Data

US 2003/0141826 A1 Jul. 31, 2003

(51) Int. Cl.[7] ..... H05B 41/16; H01J 17/20
(52) U.S. Cl. ..... 315/246; 313/638
(58) Field of Search ..... 315/246, 248, 315/363; 313/631, 634, 636, 637, 638, 639

(56) References Cited

U.S. PATENT DOCUMENTS 3,566,178 A * 2/1971 Leo Mori et al. ..... 313/639
3,786,297 A 1/1974 Zollweg et al. ..... 313/229
4,422,011 A * 12/1983 Bruninx-Poesen et al. .. 313/642
4,978,884 A 12/1990 Van Vliet et al. ..... 313/25
5,144,201 A * 9/1992 Graham et al. ..... 313/634
5,184,044 A * 2/1993 Thomas ..... 313/638
5,239,232 A 8/1993 Heider et al. ..... 313/639
5,363,015 A 11/1994 Dakin et al. ..... 313/638
5,471,110 A * 11/1995 van der Leeuw et al. .... 313/25
5,708,328 A * 1/1998 Mathews et al. ..... 313/573
5,773,932 A 6/1998 Ooyama et al. ..... 313/639
5,932,976 A * 8/1999 Maheshwari et al. ..... 315/291
5,973,453 A 10/1999 Van Vliet et al. ..... 313/623
6,069,456 A 5/2000 Fromm et al. ..... 315/248
6,136,736 A * 10/2000 Rajaram et al. ..... 501/54
6,215,254 B1 * 4/2001 Honda et al. ..... 315/246
6,300,729 B1 10/2001 Keijser et al. ..... 313/326

* cited by examiner

*Primary Examiner*—Don Wong
*Assistant Examiner*—Minh D A
(74) *Attorney, Agent, or Firm*—Kinney & Lange, P.A.

(57) ABSTRACT

An arc discharge metal halide lamp for use in selected lighting fixtures having a discharge chamber with light permeable ceramic walls of a selected shape about a discharge region of a selected volume. A pair of electrodes are supported in the discharge region separated from one another by a separation length. The separation length is in a ratio to the effective inner diameter that is greater than four. Ionizable materials are provided in the discharge region comprising a quantity of mercury in a ratio to the discharge region volume that is less than 4 mg/cm$^3$, a noble gas, praseodymium halide, and sodium halide.

15 Claims, 11 Drawing Sheets

HIGH EFFICACY METAL HALIDE LAMP WITH PRASEODYMIUM AND SODIUM HALIDES IN A CONFIGURED CHAMBER

BACKGROUND OF THE INVENTION

This invention relates to high intensity arc discharge lamps and more particularly to high intensity arc discharge metal halide lamps having high efficacy.

Due to the ever-increasing need for energy conserving lighting systems that are used for interior and exterior lighting, lamps with increasing lamp efficacy are being developed for general lighting applications. Thus, for instance, electrodeless fluorescent lamps have been recently introduced in markets for indoor, outdoor, industrial, and commercial applications. An advantage of such electrodeless lamps is the removal of internal electrodes and heating filaments that are a life-limiting factor of conventional fluorescent lamps. However, electrodeless lamp systems are much more expensive because of the need for a radio frequency power system which leads to a larger and more complex lamp fixture design to accommodate the radio frequency coil with the lamp and electromagnetic interference with other electronic instruments along with difficult starting conditions thereby requiring additional circuitry arrangements.

Another kind of high efficacy lamp is the arc discharge metal halide lamp that is being more and more widely used for interior and exterior lighting. Such lamps are well known and include a light-transmissive arc discharge chamber sealed about an enclosed a pair of spaced apart electrodes and typically further contain suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

Such lamps may have a ceramic material arc discharge chamber that usually contains quantities of NaI, TlI and rare earth halides such as $DyI_3$, $HoI_3$, and $TmI_3$ along with mercury to provide an adequate voltage drop or loading between the electrodes. Lamps containing those materials have good performance on Correlated Color Temperature (CCT), Color Rendering Index (CRI), and a relatively high efficacy, up to 95 lumens-per-watt (LPW). Of course, to further save electric energy in lighting by using more efficient lamps, high intensity arc discharge metal halide lamps with even higher lamp efficacies are needed. More electric energy can be saved by dimming such lamps in use when full light output is not needed through reducing the electrical current therethrough, and so high intensity arc discharge metal halide lamps with good performance under such dimming conditions are desirable for many lighting applications. However, under these dimming conditions when lamp power is reduced to about 50% of rated value, such ceramic material chamber arc discharge metal halide lamps radiate light in which the color rendering index decreases significantly through having a strong green hue due to relatively strong Tl radiation. Thus, there is a desire for arc discharge metal halide lamps having higher efficacies and better color performance under dimming conditions.

BRIEF SUMMARY OF THE INVENTION

The present invention provides an arc discharge metal halide lamp for use in selected lighting fixtures having a discharge chamber with light permeable walls of a selected shape bounding a discharge region of a selected volume through which walls a pair of electrodes are supported in the discharge region separated from one another by a separation length. The walls also have an effective inner diameter over the separation length in directions substantially perpendicular to the separation length with the separation length being in a ratio to the effective inner diameter that is greater than four. Ionizable materials are provided in the discharge region of the discharge chamber comprising a quantity of mercury in a ratio to the discharge region volume that is less than 4 $mg/cm^3$, a noble gas, a praseodymium halide, and a sodium halide.

The discharge chamber can have walls formed of polycrystalline alumina, and can be enclosed in a transparent bulbous envelope positioned in a base with electrical interconnections extending from the discharge chamber to the base. The ionizable materials can further include a cerium halide, and the praseodymium halide and the sodium halide can be $PrI_3$ and NaI, respectively. The ratio of the mercury quantity to the discharge region volume can be less than 1 $mg/cm^3$.

DETAILED DESCRIPTION

Figure 1:
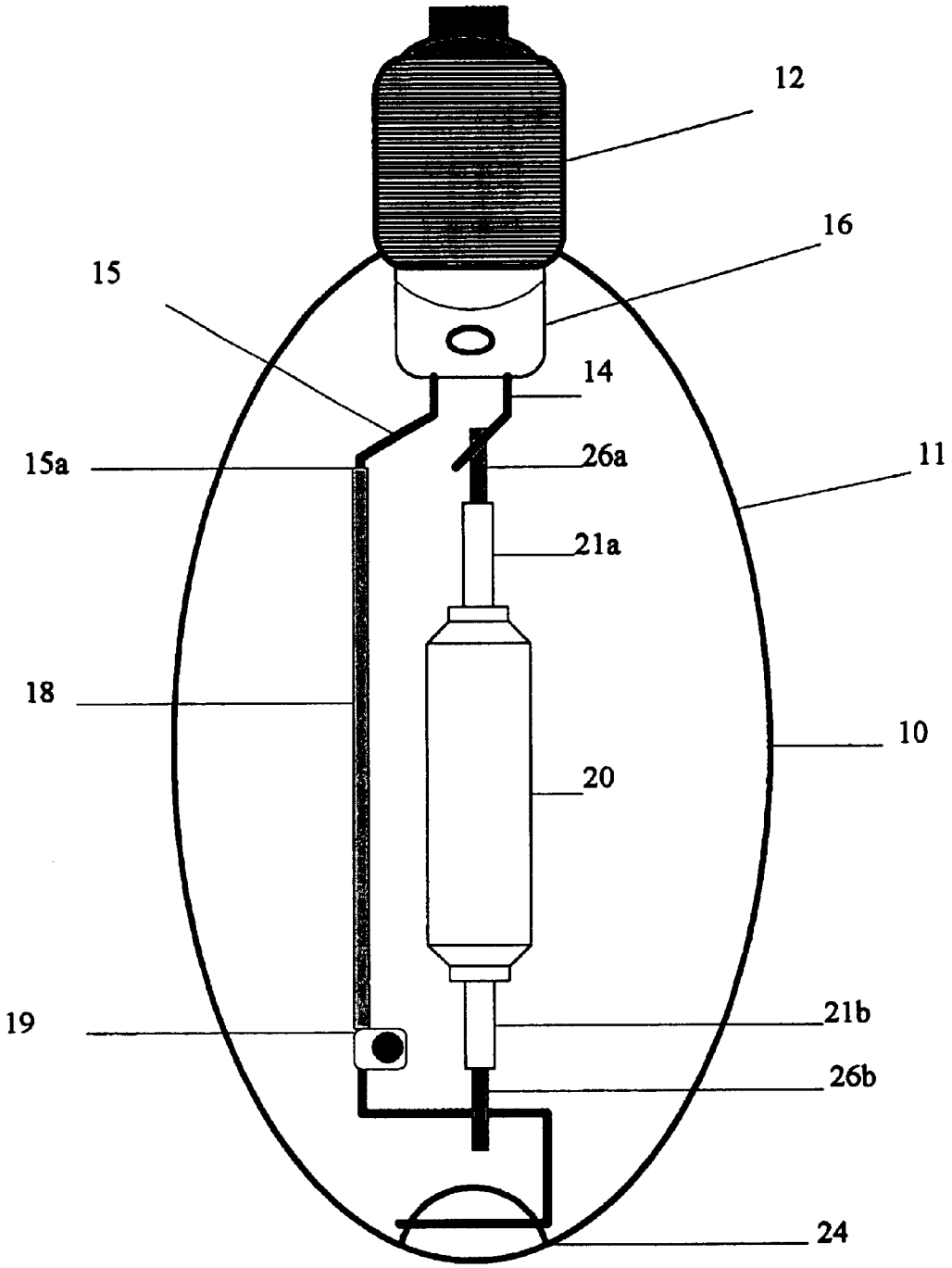
FIG. 1 is a side view, partially in cross section, of an arc discharge metal halide lamp of the present invention having a configuration of a ceramic arc discharge chamber therein.

Referring to FIG. 1, an arc discharge metal halide lamp, 10, is shown in a partial cross section view having a bulbous borosilicate glass envelope, 11, partially cut away in this view, fitted into a conventional Edison-type metal base, 12.

Lead-in electrode wires, 14 and 15, of nickel or soft steel each extend from a corresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past flare 16 to have portions thereof located further into the interior of envelope 11. Some remaining portion of each of access wires 14 and 15 in the interior of envelope 11 are bent at acute angles away from this initial direction after which bent access wire 14 ends following some further extending thereof to result in it more or less crossing the envelope length axis.

Access wire 15, however, with the first bend therein past flare 16 directing it away from the envelope length axis, is bent again to have the next portion thereof extend substantially parallel that axis, and further bent again at a right angle to have the succeeding portion thereof extend substantially perpendicular to, and more or less cross that axis near the other end of envelope 11 opposite that end thereof fitted into base 12. The portion of wire 15 parallel to the envelope length axis passes through an aluminum oxide ceramic tube, 18, to prevent the production of photoelectrons from the surface thereof during operation of the lamp, and also supports a conventional getter, 19, to capture gaseous impurities. A further two right angle bends in wire 15 places a short remaining end portion of that wire below and parallel to the portion thereof originally described as crossing the envelope length axis which short end portion is finally anchored at this far end of envelope 11 from base 12 in a borosilicate glass dimple, 24.

A ceramic arc discharge chamber, 20, configured about a contained region as a shell structure having polycrystalline alumina walls that are translucent to visible light, is shown in one possible configuration in FIG. 1. Chamber 20 has a pair of small inner and outer diameter ceramic truncated cylindrical shell portions, or tubes, 21*a* and 21*b*, that are shrink fitted into a corresponding one of the two open ends of the primary chamber structure, 25. Primary chamber structure 25 has a larger diameter truncated cylindrical shell portion between the chamber ends and a very short extent smaller diameter truncated cylindrical shell portion at each end with a partial conical shell portion there joining the smaller diameter truncated cylindrical shell portion there to the larger diameter truncated cylindrical shell portion.

Chamber electrode interconnection wires, 26*a* and 26*b*, of niobium each extend out of a corresponding one of tubes 21*a* and 21*b* to reach and be attached by welding to, respectively, access wire 14 at its end portion crossing the envelope length axis and to access wire 15 at its portion originally described as crossing the envelope length axis. This arrangement results in chamber 20 being positioned and supported between these portions of access wires 14 and 15 so that its long dimension axis approximately coincides with the envelope length axis, and further allows electrical power to be provided therethrough to chamber 20.

Figure 2:
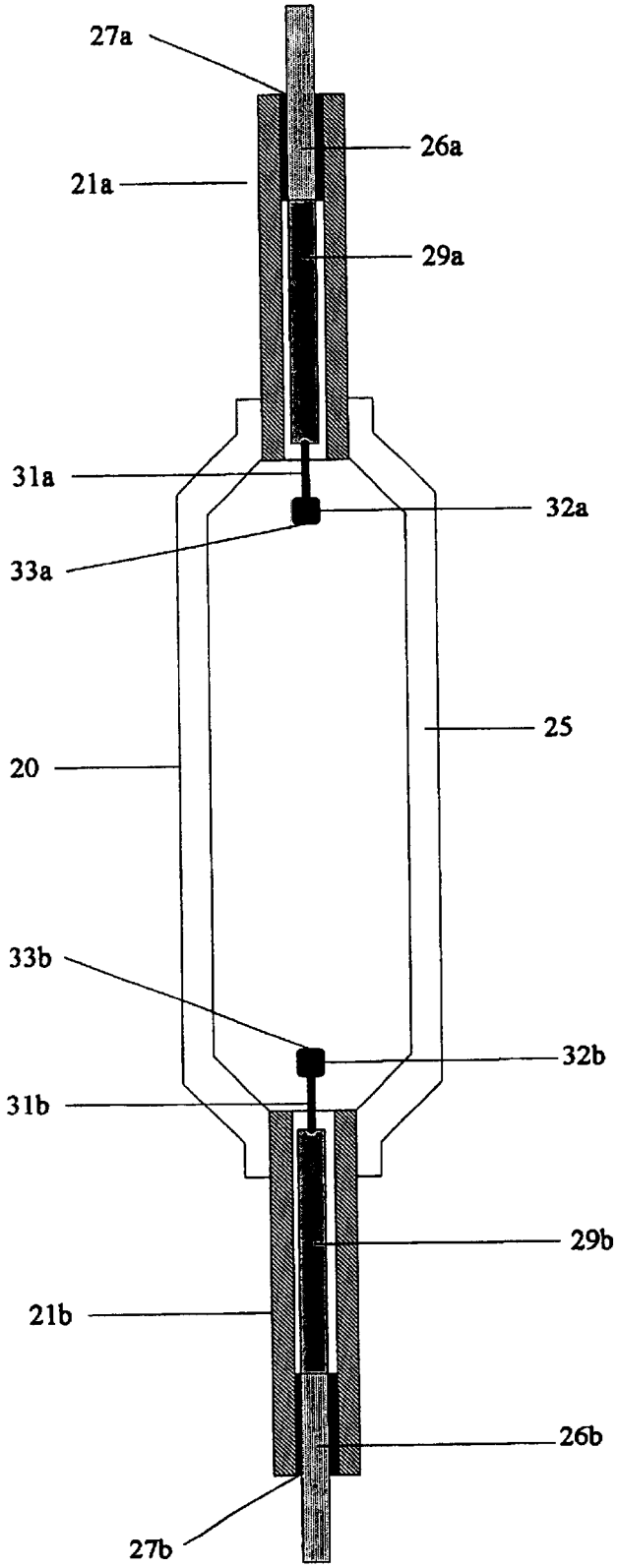
FIG. 2 shows the arc discharge chamber of FIG. 1 in cross section in an expanded view.

FIG. 2 is a cross section view of arc discharge chamber 20 of FIG. 1 showing the discharge region therein contained within its bounding walls that are provided by structure 25 and tubes 21*a* and 21*b*. Chamber electrode interconnection wire 26*a*, being of niobium, has a thermal expansion characteristic that relatively closely matches that of tube 21*a* and that of a glass frit, 27*a*, affixing wire 26*a* to the inner surface of tube 21*a* (and hermetically sealing that interconnection wire opening with wire 26*a* passing therethrough) but cannot withstand the resulting chemical attack resulting in the forming of a plasma in the main volume of chamber 20 during operation. Thus, a molybdenum lead-through wire, 29*a*, which can withstand operation in the plasma, is connected to one end of interconnection wire 26*a* by welding, and other end of lead-through-wire 29*a* is connected to one end of a tungsten main electrode shaft, 31*a*, by welding.

In addition, a tungsten electrode coil, 32*a*, is integrated and mounted to the tip portion of the other end of the first main electrode shaft 31*a* by welding, so that electrode 33*a* is configured by main electrode shaft 31*a* and electrode coil 32*a*. Electrode 33*a* is formed of tungsten for good thermionic emission of electrons while withstanding relatively well the chemical attack of the metal halide plasma. Lead-through wire 29*a* serves to dispose electrode 33*a* at a predetermined position in the region contained in the main volume of arc discharge chamber 20. A typical diameter of interconnection wire 26*a* is 0.9 mm, and a typical diameter of electrode shaft 31*a* is 0.5 mm.

Similarly, in FIG. 2, chamber electrode interconnection wire 26*b* is affixed by a glass frit, 27*b*, to the inner surface of tube 21*b* (and hermetically sealing that interconnection wire opening with wire 26*b* passing therethrough). A molybdenum lead-through wire, 29*b*, is connected to one end of interconnection wire 26*b* by welding, and other end of lead-through-wire 29*b* is connected to one end of a tungsten main electrode shaft, 31*b*, by welding. A tungsten electrode coil, 32*b*, is integrated and mounted to the tip portion of the other end of the first main electrode shaft 31*b* by welding, so that electrode 33*b* is configured by main electrode shaft 31*b* and electrode coil 32*b*. Lead-through wire 29*b* serves to dispose electrode 33*b* at a predetermined position in the region contained in the main volume of arc discharge chamber 20. A typical diameter of interconnection wire 26*b* is also 0.9 mm, and a typical diameter of electrode shaft 31 is again 0.5 mm.

Figure 3:
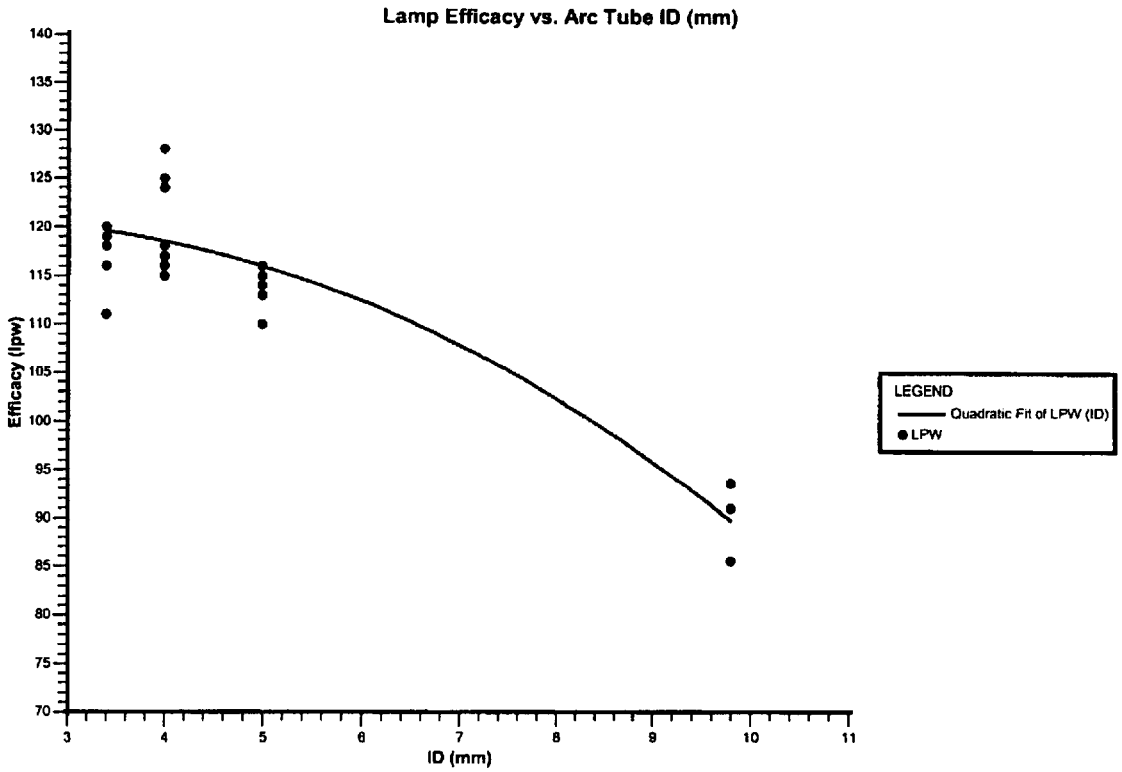
FIG. 3 is a graph showing a plot of lamp efficacy (LPW) versus arc discharge chamber effective diameter for typical lamps of the present invention.
Figure 4:
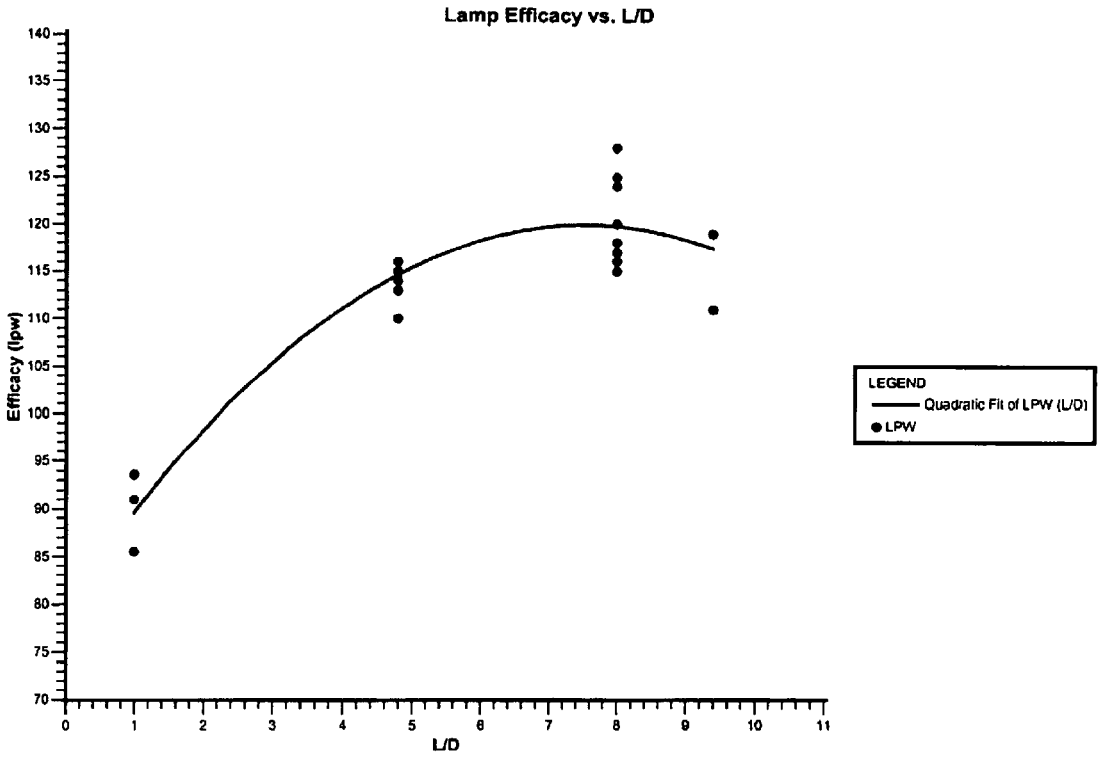
FIG. 4 is a graph showing a plot of lamp efficacy (LPW) versus ratios of arc discharge chamber electrode separation length to effective diameter for typical lamps of the present invention.

A further lamp structural consideration is the ratio of the arc chamber electrode separation length or distance, "L", to the arc chamber wall effective inner diameter, "D", (or, alternatively, the effective inner radius) over that electrode separation distance. This ratio is a significant factor in choosing the arc chamber configuration along with the chamber total contained volume (which forms the discharge region) insofar as the ratios of quantities of active materials contained therein to that volume. This aspect ratio of L to D influences the amount of light being radially emitted from the arc chamber, the excited state distribution of active material atoms, the broadening of the material emission lines, etc. In addition, smaller arc chamber effective diameters will reduce the self-absorption of strong radiating spectral lines of the radiating metals in arc chambers. The increase of self-absorption with increasing arc chamber effective diameters will reduce lamp efficacy (see FIGS. 3 and 4). If a long lamp life is to be achieved, the arc chamber power wall loading must be limited to some maximum value, about 30 to 35 W/cm$^2$ for low wattage metal halide lamps with ceramic arc discharge chambers. At higher power loadings, typically, the chemical reactions of the active material salts with the arc chamber walls and the frit material become so severe that there is substantial difficulty in obtaining sufficient useful operating lives from such devices.

The arc chamber electrode separation length and the arc chamber effective diameter or radius over that separation length cannot be independently chosen. For smaller arc chamber effective diameters, the arc chamber electrode separation length has to be increased to reduce or eliminate the otherwise resulting increase arc chamber wall loading by increasing the inner wall area. In maintaining a fixed wall loading value, the longer the arc chamber electrode separation length, the smaller the arc chamber effective diameter or radius can be. In the situation of holding the ratio of arc chamber electrode separation length to arc chamber effective diameter or radius fixed, the greater the wall loading value that can be accepted, the greater the resulting efficiency in generating light radiation by the metal halide discharge arc in the arc chamber until that efficiency reaches a limiting value. Lamps should have arc chambers with ratios of L/D that are greater than four for reasonable operating efficiencies, and lamps having relatively larger ratios of L/D, at about 7 to 9, have been found to give the highest lamp efficiencies (see FIGS. 3 and 4).

Figure 5:
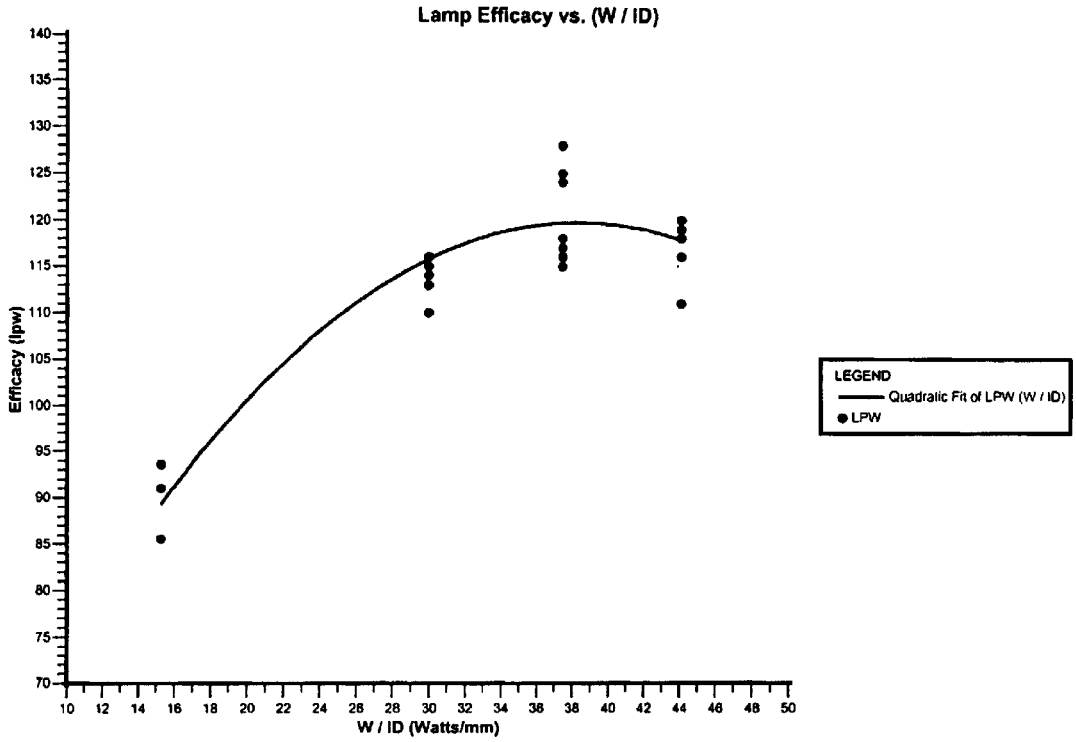
FIG. 5 is a graph showing a plot of lamp efficacy (LPW) versus ratios of arc discharge power to effective diameter for typical lamps of the present invention.

A parameter for characterizing arc discharge lamps, termed normalized wall loading (watts/arc tube diameter), combines the effects of wall loading and radiation trapping phenomena into one combined measure thereof. As can be seen from FIG. 5, a plot of efficacy (LPW) vs. this normalized wall loading (W/D=watts/D for arc chambers) parameter for such arc chambers, lamp efficacies can be increased with increasing arc chamber wall loading up to a maximum value and, thereafter, the efficacy more or less saturates. This indicates there is no further efficacy gain in either further increasing wall loadings or further reducing arc chamber diameters, or combinations thereof leading to larger normalized wall loading parameter values. In the arc chambers characterized in FIG. 5, the optimum efficacy is obtained at normalized wall loading parameter values of around 32 to 36 watts/mm. Beyond these values, there are either diminishing returns or no gain in efficacy and, most likely, a reduced lamp operating life.

Figure 6:
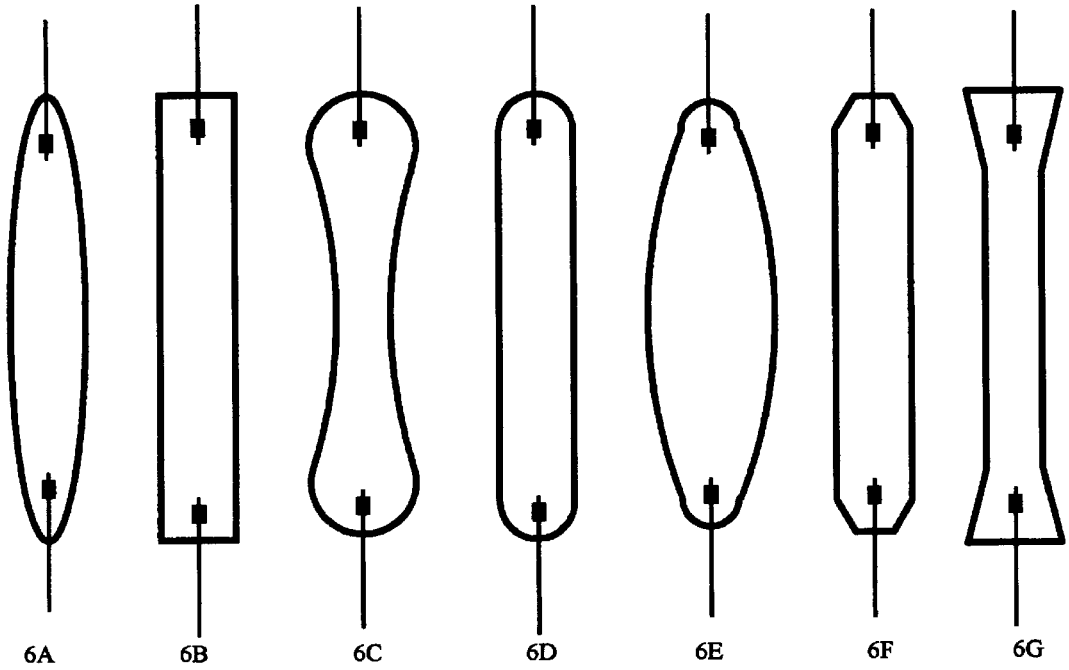
FIGS. 6A through 6G shows alternatives for the arc discharge chamber of FIG. 1 in cross section views.

Arc chamber 20 can be configured with alternative geometrical shapes different from the configuration of FIGS. 1 and 2 as shown in the examples of FIGS. 6A through 6G. In each instance shown in FIGS. 1 and 2, and in FIGS. 6A through 6G, a cross section view through the length axis of the arc chamber configuration is shown with the inner and outer wall surfaces being surfaces of revolution about the chamber length axis although this is not necessarily required. The effective diameter D of such inner surfaces can be found by determining the interior area of the cross section view between the electrodes, i.e. over the electrode separation length L, and dividing that area by L. Other kinds of inner surfaces may require a more elaborate averaging procedure to determine an effective diameter therefor. FIG. 6A shows an arc chamber having its cross section forming an ellipse; FIG. 6B shows a cross section forming a right cylinder truncated with flat ends; FIG. 6C shows a cross section formed with hemispherical ends and concave sides; FIG. 6D shows a cross section forming a right cylinder truncated with hemispherical ends; FIG. 6E shows a cross section formed with hemispherical ends merging with elliptical sides; FIG. 6F shows a cross section forming a right cylinder truncated with smaller diameter flat ends joined to the cylinder with partial cones to provide a narrowing taper therebetween; and FIG. 6G shows a cross section forming a right cylinder truncated with larger diameter flat ends joined to the cylinder with partial inverted cones to provide a outward flaring taper therebetween. Many further alternative configurations are possible with some more desirable on various grounds than others.

Thus, every alternative configuration has its advantages and disadvantages. That is, for specific active materials and other lamp characteristics, certain arc chamber configurations have more advantages than do others.

In a first implementation of the present lamp, arc discharge chamber 20 is made from polycrystalline alumina to have a cavity length in the contained discharge region of about 36 mm, for the configuration thereof shown in FIGS. 1 and 2, with the inner diameter of this chamber between electrodes 33*a* and 33*b* being about 4 mm. Electrodes 33*a* and 33*b* are spaced apart in the region contained in the chamber by about 32 mm to yield an arc length of the same value. The rated power of the lamp is nominally 150 W. The quantities of active materials provided in the discharge region contained within arc discharge chamber 20 were 0.5 mg Hg and 10 to 15 mg of the metal halides $PrI_3$ and NaI in a $PrI_3$:NaI molar ratio range of 1:3.5 to 1:10.5. In addition, Xe gas was provided in this region at a pressure of about 330 mbar at room temperature as an ignition gas.

In a second implementation of the present lamp, another metal halide is added therein and a shorter but wider arc chamber of the same configuration otherwise is used. The cavity length of arc discharge chamber 20 in this instance in the contained discharge region is about 28 mm with the inner diameter of the chamber between the electrodes being about 5 mm, and the electrodes were spaced apart to provide an arc length of about 24 mm. The rated power of the lamp is again 150 W. The quantities of active materials provided in the discharge region contained within arc discharge chamber 20 were 2.2 mg Hg and 15 mg of the metal halides $PrI_3$, $CeI_3$ and NaI in alternative $PrI_3$:$CeI_3$:NaI molar ratios of 0.5:1:15.75,0.88:1:19.69, or 2:1:31.5. Again, Xc gas was provided in this region at a pressure of about 330 mbar at room temperature as an ignition gas.

Figure 7:
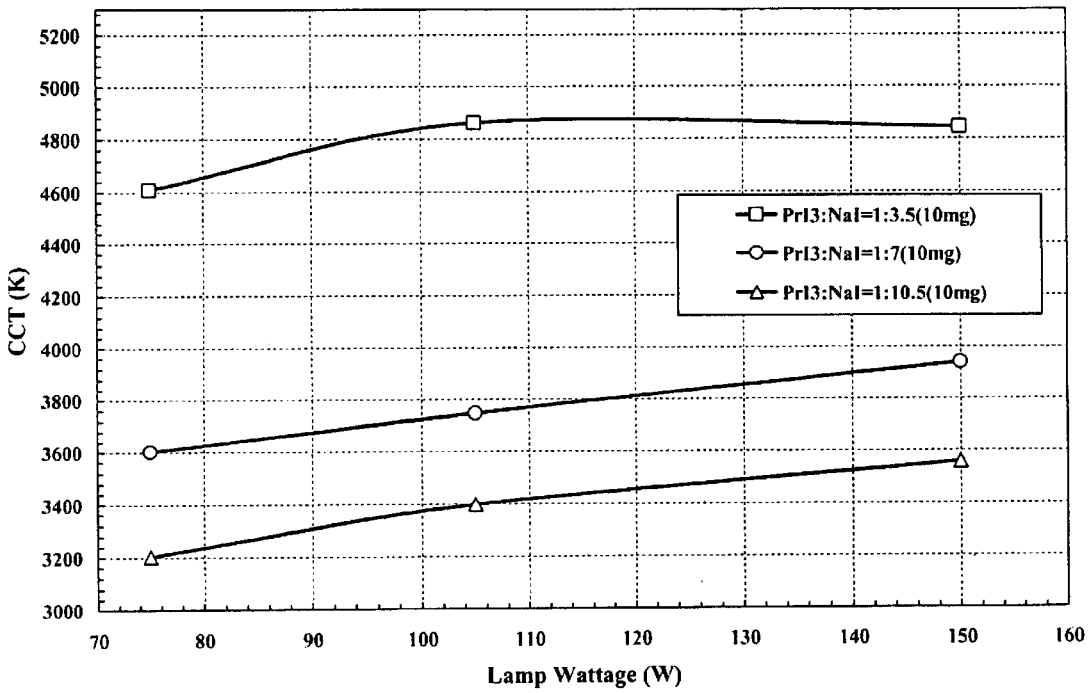
FIG. 7 shows the Correlated Color Temperature (CCT) changes for typical lamps of the present invention using alternative molar ratios of $PrI_3$ and NaI as active materials therein for dimming from 150 W to 75 W.

FIG. 7 shows relationships between CCT changes and lamp power changes of typical combined $PrI_3$ and NaI active materials lamps based on, or similar to, the first realization of such lamps given just above for different halide active material molar ratios. When the lamps are dimmed from their full rated power by limiting the electrical current therethrough, the corresponding CCT values decrease. The changes in CCT values in the lamps of the present invention are substantially smaller compared with CCT value changes in existing lamps when each kind is dimmed to 50% of its rated power.

Figure 8:
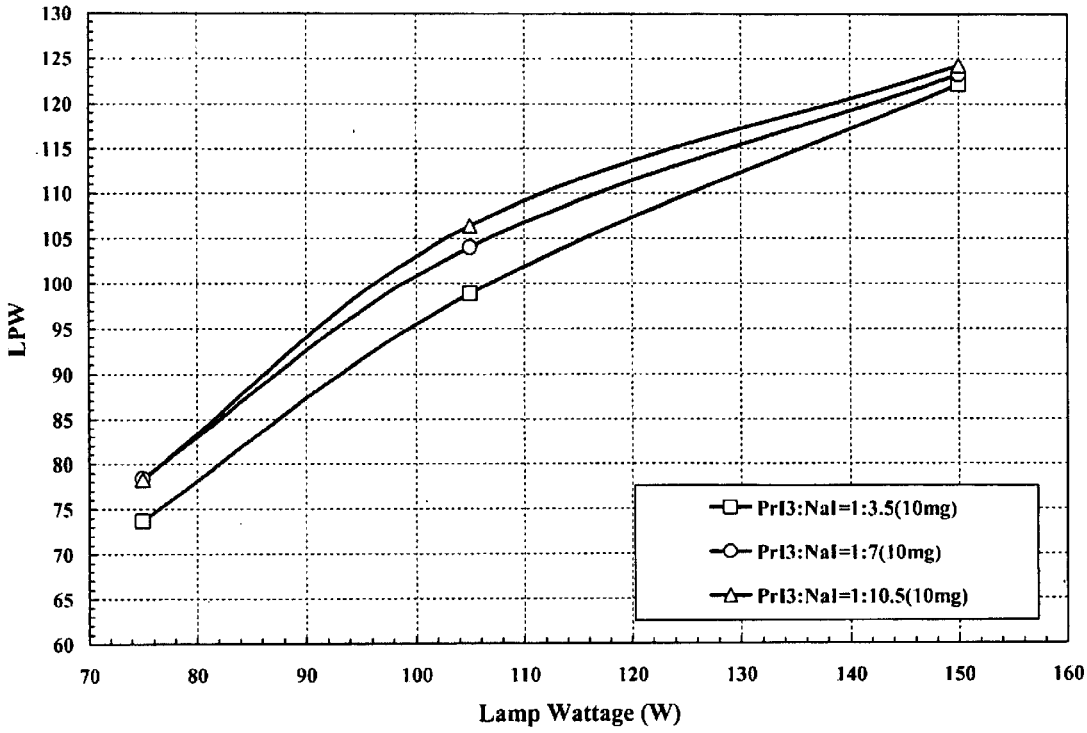
FIG. 8 shows the lamp efficacy (LPW) changes for typical lamps of the present invention using alternative molar ratios of $PrI_3$ and NaI as active materials therein for dimming from 150 W to 75 W.

FIG. 8 shows relationships between lamp efficacy (LPW) changes and the lamp power changes of typical combined $PrI_3$ and NaI active materials lamps based on, or similar to, the first realization of such lamps given just above for different halide active material molar ratios. When the lamps are dimmed from their full rated power by limiting the electrical current therethrough while operating at line voltage, the corresponding efficacy values decrease. The changes in lamp efficacy values in the lamps of the present invention are substantially the same compared with lamp efficacy value changes of existing lamps when each kind is dimmed to 50% of its rated power.

Figure 9:
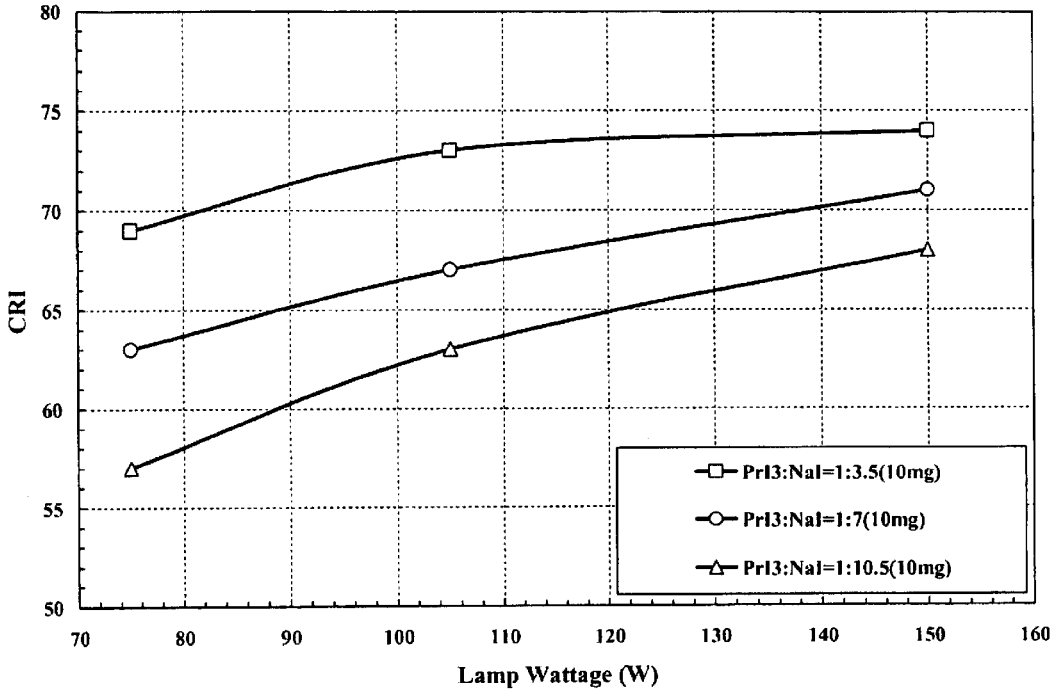
FIG. 9 shows the Color Rendering Index (CRI) changes for typical lamps of the present invention using alternative molar ratios of $PrI_3$ and NaI as active materials therein for dimming from 150 W to 75 W.

FIG. 9 shows relationships between lamp CRI changes and lamp power changes of typical combined $PrI_3$ and NaI active materials lamps based on, or similar to, the first realization of such lamps given just above for different halide active material molar ratios. When lamps are dimmed from their full rated power by limiting the electrical current therethrough while operating at line voltage, the corresponding CRI values decrease. The changes in lamp CRI values in the lamps of the present invention are substantially smaller compared with the lamp efficacy value changes of existing lamps when each kind is dimmed to 50% of its rated power.

Figure 10:
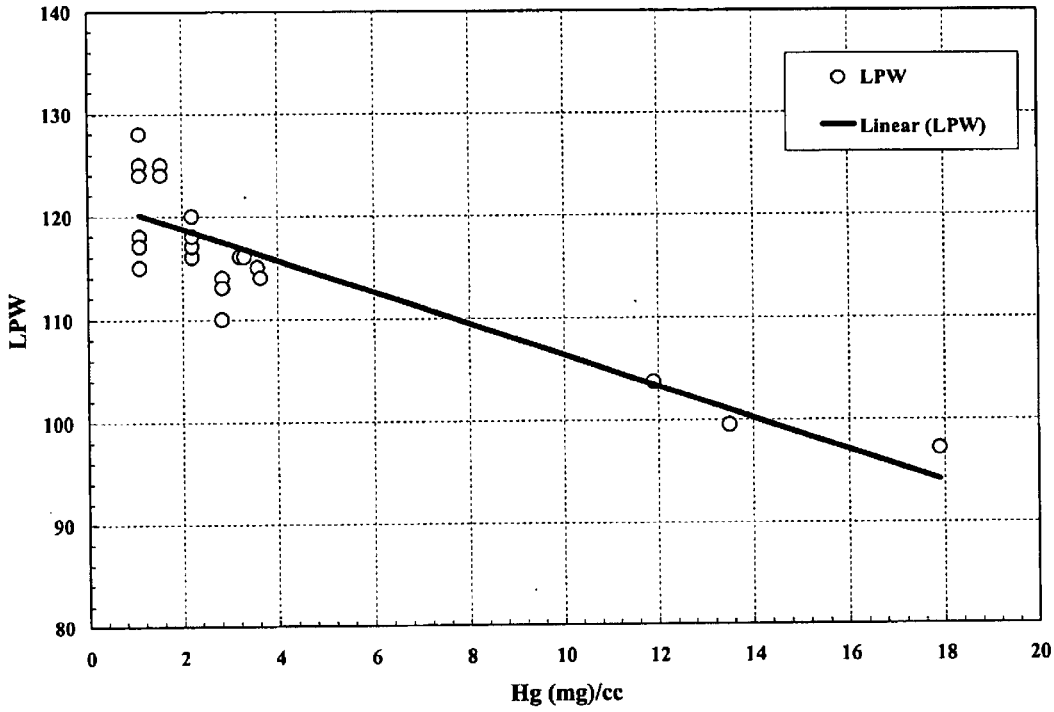
FIG. 10 shows lamp efficacy (LPW) versus the mercury dose amount per unit discharge chamber volume for typical lamps of the present invention.

FIG. 10 shows the relationship between lamp efficacy and the mercury dose amount per unit volume of the contained region used in an arc chamber of typical lamps of the present invention. For lamps operated at a specific lamp voltage, a relatively lower mercury dose per unit chamber volume is used in narrower and longer arc chambers such as the one used in the first implementation above, and a relatively higher mercury dose per unit volume is used in wider and shorter arc chambers such as the one used in the second implementation above. Lamps using a lower mercury dose per unit chamber volume have relatively higher lamp efficacy values for the Pr and Na halide active materials.

A further set of implementations are given as examples in the following differing from the implementations given above to indicate various ranges contemplated in the present invention. A table of tabulated corresponding photometry results for each of these examples is presented thereafter for operation at full rated power and at half rated power with both conditions at line voltage and with current being limited accordingly.

EXAMPLE 1

The quantities of active materials provided in the discharge region contained within arc discharge chamber 20 were 0.5 mg Hg and 15 mg total of metal halides NaI and $PrI_3$ in a molar ratio of $PrI_3$:NaI=1:3.5. Xe gas was provided in this region at a pressure of about 330 mbar at room temperature. The volume of discharge chamber 20 is 0.45 $cm^3$ and the arc length between the electrodes is 32 mm. Wall loading is 31 $W/cm^2$ at 150 W. Lamp photometry results are shown in Table 1 below.

EXAMPLE 2

The quantities of active materials provided in the discharge region contained within arc discharge chamber 20 were 0.5 mg Hg and 10 mg total of metal halides NaI and $PrI_3$ in a molar ratio of $PrI_3$:NaI=1:3.5. Xe gas was provided in this region at a pressure of about 330 mbar at room temperature. The volume of discharge chamber 20 is 0.45 $cm^3$ the arc length between the electrodes is 32 mm. Wall loading is 31 $W/cm^2$ at 150 W. Lamp photometry results are shown in Table 1 below.

EXAMPLE 3

The quantities of active materials provided in the discharge region contained within arc discharge chamber 20 were 0.5 mg Hg and 10 mg total of metal halides NaI and $PrI_3$ in a molar ratio of $PrI_3$:NaI=1:7. Xe gas was provided in this region at a pressure of about 330 mbar at room temperature. The volume of discharge chamber 20 is 0.45 $cm^3$ and the arc length between the electrodes is 32 mm. Wall loading is 31 $W/cm^2$ at 150 W. Lamp photometry results are shown in Table 1 below.

EXAMPLE 4

The quantities of active materials provided in the discharge region contained within arc discharge chamber 20 were 0.5 mg Hg and 12.5 mg total of metal halides NaI and $PrI_3$ in a molar ratio of $PrI_3$:NaI=1:7. Xe gas was provided in this region at a pressure of about 330 mbar at room temperature. The volume of discharge chamber 20 is 0.45 $cm^3$ and the arc length between the electrodes is 32 mm. Wall loading is 31 $W/cm^2$ at 150 W. Lamp photometry results are shown in Table 1 below.

EXAMPLE 5

The quantities of active materials provided in the discharge region contained within arc discharge chamber 20 were 0.5 mg Hg and 10 mg total of metal halides NaI and $PrI_3$ in a molar ratio of $PrI_3$:NaI=1:10. Xe gas was provided in this region at a pressure of about 330 mbar at room temperature. The volume of discharge chamber 20 is 0.45 $cm^3$ and the arc length between the electrodes is 32 mm. Wall loading is 31 $W/cm^2$ at 150 W. Lamp photometry results are shown in Table 1 below.

EXAMPLE 6

The quantities of active materials provided in the discharge region contained within arc discharge chamber 20 were 2.2 mg Hg and 15 mg total of metal halides $PrI_3$, $CeI_3$ and NaI in molar ratios of $PrI_3$:$CeI_3$:NaI=0.5:1:10.5. Xe gas was provided in this region at a pressure of about 330 mbar at room temperature. The volume of discharge chamber 20 is 0.55 $cm^3$ and the arc length between the electrodes is 24 mm. Wall loading is 31.3 $W/cm^2$ at 150 W. Lamp photometry results are shown in Table 1 below.

EXAMPLE 7

The quantities of active materials provided in the discharge region contained within arc discharge chamber 20 were 2.2 mg Hg and 15 mg total of metal halides $PrI_3$, $CeI_3$ and NaI in molar ratios of $PrI_3$:$CeI_3$:NaI=0.8:1:19.69. Xe gas was provided in this region at a pressure of about 330 mbar at room temperature. The volume of discharge chamber 20 is 0.55 $cm^3$ and the arc length between the electrodes is 24 mm. Wall loading is 31.3 $W/Cm^2$ at 150 W. Lamp photometry results are shown in Table 1 below.

EXAMPLE 8

The quantities of active materials provided in the discharge region contained within arc discharge chamber 20 were 2.2 mg Hg and 15 mg total of metal halides $PrI_3$, $CeI_3$ and NaI in molar ratios of $PrI_3$:$CeI_3$:NaI=2:1:31.5. Xe gas was provided in this region at a pressure of about 330 mbar at room temperature. The volume of discharge chamber 20 is 0.55 $cm^3$ and the arc length between the electrodes is 24 mm. Wall loading is 31.3 $W/Cm^2$ at 150 W. Lamp photometry results are shown in Table 1 below.

TABLE 1

Photometry data corresponding to the above lamp examples at full and half rated operating powers

| Sample Lamp | Wattage | LPW | CCT | CRI |
|---|---|---|---|---|
| #1 | 150 | 118 | 4904 | 73 |
| #1 | 75 | 56 | 4460 | 68 |
| #2 | 150 | 118 | 4976 | 74 |
| #2 | 75 | 60 | 4653 | 66 |
| #3 | 150 | 128 | 4144 | 69 |
| #3 | 75 | 58 | 4351 | 54 |
| #4 | 150 | 125 | 4380 | 69 |
| #4 | 75 | 59 | 4011 | 62 |
| #5 | 150 | 125 | 3693 | 65 |
| #5 | 75 | 67 | 3467 | 62 |
| #6 | 150 | 127 | 3718 | 66 |
| #7 | 150 | 124 | 4128 | 71 |
| #8 | 150 | 119 | 4002 | 73 |

In reducing the operating power of the lamps of the above examples to half, the emitted light remained substantially white without a greenish hue. Such color was satisfactory to the eye for general illumination uses and it was substantially impossible to discern any color or hue change under such dimmed conditions. Thus, the lamps of the present invention remain at the same CCT and are substantially constant in terms of hue throughout the dimming range, and further, they have higher lumen efficacy compared to the standard lamps at rated power.

Figure 11:
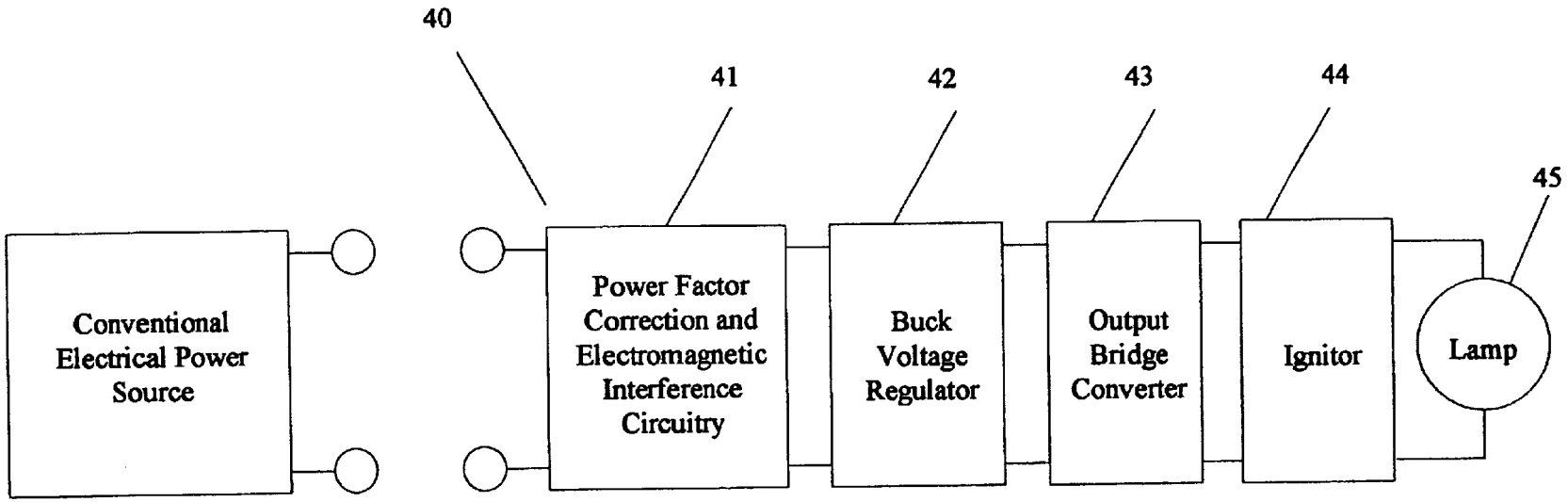
FIG. 11 shows a circuit in a diagrammatic form suitable for operating typical lamps of the present invention.

Such dimming of lamps of the present invention from full power during operation is accomplished through operating the lamps in an electronic ballast circuit, a well known version of which, 40, is shown in block diagram form in FIG. 11. The electrical power for the circuit and lamp is drawn from a conventional 60 Hertz alternating current source which supplies such current at a fixed voltage to a power factor correction and electromagnetic interference filter circuit portion, 41. This circuit portion converts the alternating polarity line voltage to a constant polarity voltage of a value significantly greater than the peak line voltage while maintaining a sinusoidal current that is in phase with the line voltage, and limits electromagnetic emissions in doing so.

This constant polarity voltage is supplied as the input voltage to a buck voltage converter or regulator, 42, which in turn provides a regulated constant polarity voltage and current output. This voltage output is reduced in magnitude from the constant polarity input voltage provided to the regulator to a value set by an internal reference, but the regulator also provides the full value of that input voltage at its output during initiation of lamp operation prior to the striking of an arc therein. Changing the value of the regulator internal reference permits changing the current supplied to the lamp being operated to thereby allow selective dimming of that lamp. The constant polarity output voltage of the regulator is changed to a low frequency square wave by an output bridge converter, 43, that is provided to an igniter, 44, that generates 4 kV starting voltage pulses for striking an arc in the lamp, 45, connected to its output while providing a square wave voltage supply to the lamp thereafter.

Although the present invention has been described with reference to preferred embodiments, workers skilled in the art will recognize that changes maybe made in form and detail without departing from the spirit and scope of the invention.

what is claimed is:

1. A metal halide lamp, comprising:

a discharge chamber having a light-transmissive chamber wall structure which defines a discharge region, a first electrode, and a second electrode, the first and second electrodes being positioned opposite to each other; and an ionizable material contained in the discharge region, the ionizable material including mercury, rare gas, and at least two types of halides which include praseodymium halide and sodium halide, wherein a diameter D of the chamber wall structure and an electrode separation distance L between the first and second electrodes cross each other substantially at right angles, and satisfy the relationship of $L/D>4$.

2. A metal halide lamp according to claim 1, wherein the chamber wall structure is formed of polycrystalline alumina.

3. A metal halide lamp according to claim 2, wherein the praseodymium halide is praseodymium iodide ($PrI_3$), and the sodium halide is sodium iodide (NaI).

4. A metal halide lamp according to claim 1, wherein the praseodymium halide is praseodymium iodide ($PrI_3$), and the sodium halide is sodium iodide (NaI).

5. A metal halide lamp according to claim 1, wherein the chamber wall structure has a first end positioned at the first electrode side and a second end positioned at the second electrode side, and the first end and the second end are tapered.

6. A metal halide lamp according to claim 5, wherein the discharge chamber further includes a thermal shield which covers at least one of the first end and the second end.

7. A metal halide lamp according to claim 1, wherein the rare gas includes xenon (Xa).

8. A metal halide lamp according to claim 1, wherein the diameter D and the electrode separation distance L satisfy the relationship of $7 \leqq L/D \leqq 9$.

9. A metal halide lamp according to claim 8, wherein the praseodymium halide is praseodymium iodide ($PrI_3$), and the sodium halide is sodium iodide (NaI).

10. A metal halide lamp according to claim 1, wherein the ratio of the amount of mercury to the volume of the discharge region is equal to or smaller than 4 $mg/cm^3$.

11. A metal halide lamp according to claim 10, wherein the praseodymium halide is praseodymium iodide ($PrI_3$), and the sodium halide is sodium iodide (NaI).

12. A metal halide lamp according to claim 1, wherein the ionizable material further includes cerium halide.

13. A metal halide lamp according to claim 1, further comprising:

a light-transmissive bulbous envelope; and a base connected to the envelope, the base having a first access wire and a second access wire extending into the envelope, wherein the discharge chamber is placed in the envelope, the first electrode is connected to the first access wire, and the second electrode is connected to the second access wire.

14. A lighting system, comprising a metal halide lamp and an operation circuit for allowing the metal halide lamp to operate, the metal halide lamp including:

a discharge chamber having a light-transmissive chamber wall structure which defines a discharge region, a first electrode, and a second electrode, the first and second electrodes being positioned opposite to each other; and an ionizable material contained in the discharge region, the ionizable material including mercury, rare gas, and at least two types of halides which include praseodymium halide and sodium halide, wherein a diameter D of the chamber wall structure and an electrode separation distance L between the first and second electrodes cross each other substantially at right angles, and satisfy the relationship of $L/D>4$, and the operation circuit being constructed so as to supply the metal halide lamp with an electric voltage for allowing the metal halide lamp to start and discharge, and to supply the metal halide lamp with an electric current for adjusting an operation power of the metal halide lamp.

15. A lighting system according to claim 14, wherein the ratio of the amount of mercury to the volume of the discharge region is equal to or smaller than 4 $mg/cm^3$.

* * * * *

UNITED STATES PATENT AND TRADEMARK OFFICE

CERTIFICATE OF CORRECTION

PATENT NO. : 6,979,958 B2
APPLICATION NO. : 10/062078
DATED : December 27, 2005
INVENTOR(S) : Zhu Huiling et al.

It is certified that error appears in the above-identified patent and that said Letters Patent is hereby corrected as shown below:

On Title Page #75 under listed of inventors, change residence of Jakob from "Lexington" to --Brookline--.

At column 10, line 10, change "Xa" to --Xe--.

Signed and Sealed this

Twenty-first Day of November, 2006

JON W. DUDAS
*Director of the United States Patent and Trademark Office*